US007753713B2

(12) United States Patent
Neale, III

(10) Patent No.: US 7,753,713 B2
(45) Date of Patent: Jul. 13, 2010

(54) UNIVERSAL SERIAL BUS STANDARD INTERFACE CONNECTIONS

(75) Inventor: Frank T. Neale, III, Roaming Shores, OH (US)

(73) Assignee: Delphi Technologies, Inc., Troy, MI (US)

( * ) Notice: Subject to any disclaimer, the term of this patent is extended or adjusted under 35 U.S.C. 154(b) by 209 days.

(21) Appl. No.: 11/811,900

(22) Filed: Jun. 12, 2007

(65) Prior Publication Data

US 2008/0311791 A1 Dec. 18, 2008

(51) Int. Cl.
*H01R 13/627* (2006.01)

(52) U.S. Cl. ..... 439/358; 439/357; 439/606; 439/607.41

(58) Field of Classification Search ..... 439/606, 439/610, 607, 609, 357–358, 378, 352–354, 439/736, 607.01, 607.41, 607.48, 607.51, 439/726

See application file for complete search history.

(56) References Cited

U.S. PATENT DOCUMENTS 5,480,327 A 1/1996 Zola
5,486,117 A * 1/1996 Chang ..... 439/357
6,116,938 A * 9/2000 Myer et al. ..... 439/353
6,328,601 B1 * 12/2001 Yip et al. ..... 439/608
6,394,824 B1 * 5/2002 Huang ..... 439/108
6,398,576 B1 * 6/2002 Hwang et al. ..... 439/354
6,585,537 B1 * 7/2003 Lee ..... 439/358
6,592,404 B2 * 7/2003 Endo ..... 439/595
6,619,989 B1 * 9/2003 Yi ..... 439/610
6,830,472 B1 * 12/2004 Wu ..... 439/358
7,285,004 B1 * 10/2007 Fukuda et al. ..... 439/358
2005/0282424 A1 12/2005 Huang et al.
2007/0049119 A1 3/2007 Fujimoto et al.
2007/0082555 A1 4/2007 Tanaka

OTHER PUBLICATIONS

European Search Report dated Nov. 10, 2008.

* cited by examiner

*Primary Examiner*—Xuong M Chung-Trans
(74) *Attorney, Agent, or Firm*—Thomas N. Twomey

(57) ABSTRACT

A consumer device interface assembly is provided that utilizes a male over-mold adapter that is operable to engage a conventional USB female shroud. A locking clip is associated with the male over-mold so as to provide locking engagement between the over-mold and the female adapter. The over-mold is universal thus allowing a host of consumer device interfaces to be used with the assembly.

15 Claims, 2 Drawing Sheets

UNIVERSAL SERIAL BUS STANDARD INTERFACE CONNECTIONS

FIELD

The present invention is directed towards an assembly adaptation device, and, more specifically, to a USB interface connector for aiding connectivity between a consumer's device and to an electrical interface of a machine or other system.

BACKGROUND

In recent times, the marketplace has developed consumer devices that employ interface connections that were uncommon to most consumer applications. For example, with the advent of the iPod® and the like, there has become a need to provide connectivity to a system, such as a vehicle, so that digital media can be uploaded to the system for broadcasting. These various consumer devices have an assortment of adapters for interfacing with computers such as Universal Serial Bus (USB), RCA inputs, jacks, and the like. The USB Standard interface connection and USB Mini-B adaptors are common interface types in the consumer industry, but not to other industrial applications.

A need has developed to now allow various media devices to be interfaced with industrial devices, machines, planes, trains and other transportation mediums. A traditional USB standard interface connections as defined and used under the USB published standards provide acceptable features as applied to their use in traditional consumer electronics by the general public. Taking the interface detail standards and packaging them with the intent of creating a connection package compatible with the know build and use environment of an industrial assembly plant (IAP) requires providing much improved physical robustness and added mate indexing control above and beyond what the existing accepted USB configurations can provide. In addition, IAP build compatibility requires yet additional features to meet increases in mated retention force and missplug resistance force as defined in SAE/USCAR-30 specific to USB. These added features will by definition interact with device details incorporated as mating standards by SAE/USCAR-30.

Traditional USB interface connectors do not meet the appropriate disengage minimums for use in the industrial environment. As such, the IJSB adapter can disengage from its female counterpart, which is undesirable.

Further areas of applicability of the present invention will become apparent from the detailed description provided herein. It should be understood that the detailed description and specific examples, while indicating preferred embodiments of the present invention, are intended for purposes of illustration only, since various changes and modifications within the spirit and scope of the invention will become apparent to those skilled in the art from this detailed description.

SUMMARY

Disclosed is a consumer device interface assembly having a female shroud with a housing and a flange for mounting to a pc board. The housing has an indexing feature, a ramp integral with the housing, and a pair of slots. The assembly includes an over-mold configured to be received within the female shroud, the over-mold having a body with a pair of arms that fit within the pair of slots of the female shroud, the body further having a tab. A connector located within the over-mold includes a cable and a body. The assembly further includes a metal lock shell configured to receive the over-mold, the shell having protrusions that receive the arms of the over-mold, an interlocking tab portion mates with the ramp of the female shroud for securing the assembly together.

Another embodiment of the consumer device includes a connector having a body, a cable secured to the body, and a consumer interface extending from the body. The device further includes a locking clip having a connector portion and a locking member, the connector portion engaging the body of the connector. The device further includes an over-mold made of plastic, the over-mold surrounding the body of said connector and securing the locking clip and connector together.

In yet another embodiment, the consumer device interface assembly includes a connector having a body and a consumer interface extending from the body, a metal locking clip secured to the connector, and an over-mold integral with the metal locking clip, the over-mold surrounding the body of the connector, the connector and clip forming a conductive path.

DETAILED DESCRIPTION

A consumer device interface assembly is provided having a connector, a locking clip, and an over-mold. The connector has a body and a consumer interface extending from the body. The locking clip is secured to the connector and prevents disassembly from its corresponding component to which it engages. The over-mold surrounds the body of the connector and provides a physically robust component to be received by a corresponding interface component.

Figure 1:
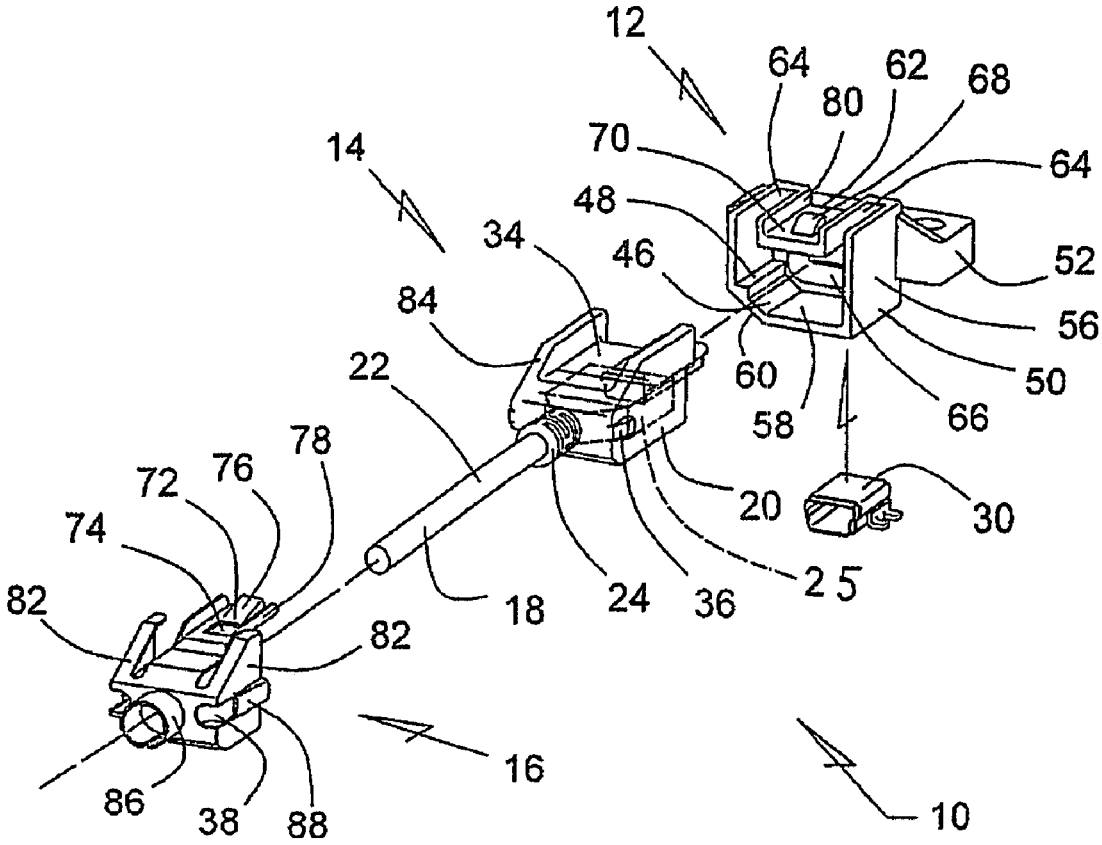
FIG. 1 is an exploded assembly of a male interface and its associated female receptacle shroud, according to an embodiment.

With reference to FIG. 1, a consumer device interface assembly 10 is illustrated having a USB Mini-B receptacle connector 12, an over-mold 14, and a lock shell 16. The over-mold 14 includes a cable assembly 18 and a body 20 integral with one another. It will be appreciated that the receptacle 12 does not have to be of the USB type illustrated, but of any variety of female connector system so as to provide connectivity to a PC board.

Figure 5:
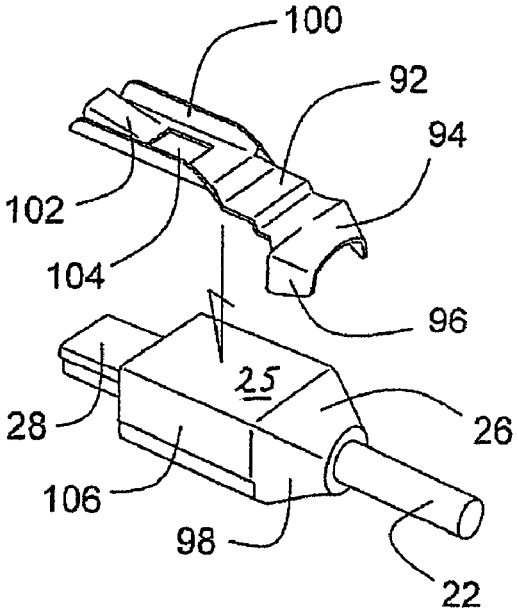
FIG. 5 is a perspective view of the FIG. 4 embodiment, showing the USB cable having a body, with the locking clip offset there from, the over-mold not being illustrated in this simplified view, according to an embodiment.

The cable assembly 18 has a cable 22, a wire strain relief 24, a connector 25 with a shell 26 made of plastic, and a consumer device interface 28 (See FIG. 5). The consumer device interface 28 illustrated is a USB Mini-B male connector that mates with a corresponding female connector 30 that is housed within the USB Mini-B receptacle 12. It will be appreciated that the consumer device interface 28 could be with any consumer interface device configuration, including, but not limited to, USB Mini-B, USB standard, and 3.5 millimeter audio/visual plugs. Thus, the over-mold 14 is universal in that it is capable of receiving cable or connector assemblies 18 of various types, yet still be allowed to mate with a standard receptacle 12. Likewise, the receptacle 12 can be of configurations besides the USB Mini-B receptacle as shown. For example, the female connector 30 can be of any configuration such as a USB Standard, or A/V jacks, or any other female connector configuration, so as to allow it to mate with its corresponding male interface component 28.

Figure 4:
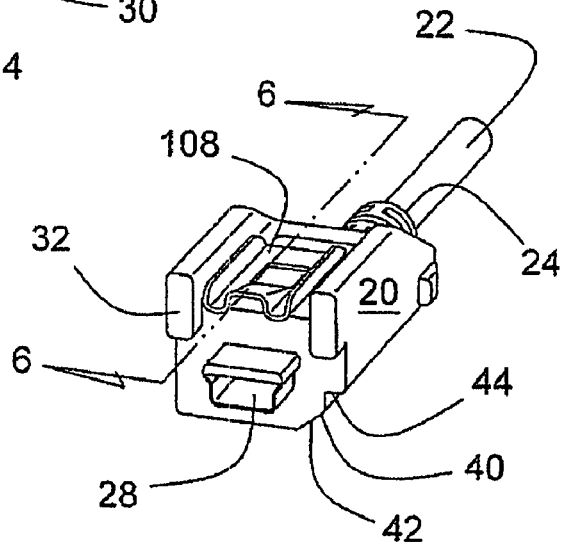
FIG. 4 is a perspective view of an alternative embodiment USB mini-receptacle assembly having an integral locking clip with its over-mold, according to an embodiment.

The universal male over-mold connector 14 has a body 20 with a pair of upwardly extending arms 32 that extend axially and are spaced apart from one another. A flattened portion 34 is recessed below the upper part of the arms 32 and provides a cavity for receiving a portion of the lock shell 16. A tab 36 is formed part of, and in one embodiment, positioned about a rear corner of the body 20 and is operable to engage an opening 38 of the lock shell 16. This allows the over-mold 14 and the lock shell 16 to securely engage one another. With reference to FIG. 4, the universal over-mold 14 has on one corner of its body 20, a self-indexing feature 40 including a chamfer 42 and an axially extending relief or corner 44. This self-indexing feature 40 corresponds with a corresponding configuration of the receptacle 12 shown in FIG. 1. Specifically, the receptacle 12 has a chamfer 46 and a lip 48 that engaged the corresponding configuration molded within the male over-mold 14. The over-mold is preferably made of plastic. This arrangement enhances quick and accurate assembly of the parts.

With continued reference to the receptacle 12 shown in FIG. 1, a housing 50 is provided with a corresponding PC board mounting member for flange 52. The receptacle 12 is preferable made of plastic and is secured to a PC board 54 (See FIG. 2) by conventional means. The housing 50 has vertical side walls 56, a base 58, the indexing feature 60 and an upper portion 62. The female connector 30 is positioned within the receptacle 12 and is secured to the PC board 54, via traditional methods. The upper portion 62 has a pair of slots 64 extending axially and are operable to receive the arms 32 from the over-mold male counterpart 14. The male over-mold 14 is configured to be slidably received within the cavity 66 that is defined by the aforementioned housing components 50. A ramp 68 is provided on the upper portion 62 within a recessed area 70. The ramp 68 is for engaging the interlocking tab 72 that is part of the lock shell 16. The interlocking tab 72 has an opening 74 that is sufficiently large to receive the entirety of the ramp 68 which, when engaged, causes the lock shell 16 and the receptacle 12, to be temporarily secured firmly together. The interlocking tab 72 further includes a raised portion 76 that engages the ramp 68, and a pair of upwardly extending flanges 78 that are received within the recessed area 70 and glide along upwardly extending walls 80. This configuration provides additional indexing control as well as a positive engagement between the receptacle 12 and the lock shell 16.

The lock shell 16 further includes upwardly extending arms 82 that are configured to be received over the ramp portion 84 of the over-mold body 20. A shroud 86 extends around the wire strain relief 24. A ramp 88 is positioned on one or both sides of the lock shell 16 and are operable to receive the tab 36 of the over-mold 14. Opening 38 is sufficiently enlarged to receive tab 36 allowing the forward edge of tab 36 to engage the rear wall of the ramp 88.

Figure 2:
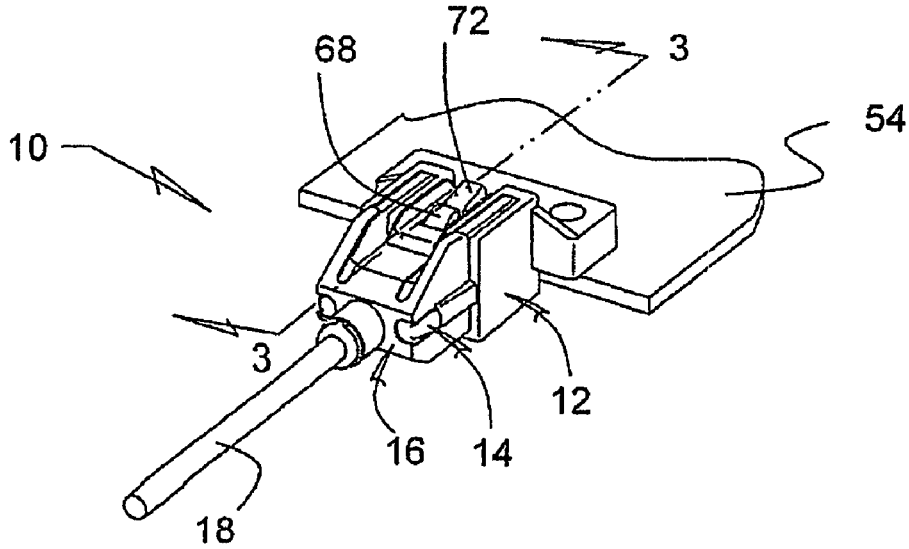
FIG. 2 is the FIG. 1 assembly shown in its connected position and with the shroud assembly secured to a PC board, according to an embodiment.

With reference to FIG. 2, the interface assembly 10 is illustrated having the receptacle 12 and the male over-mold 14 with its lock shell 16, engaged in a locking arrangement. The interlocking tab 72 is shown engaged with the ramp 68 thus securely engaging the components together. This arrangement provides a firm connection about the componentry.

Figure 3:
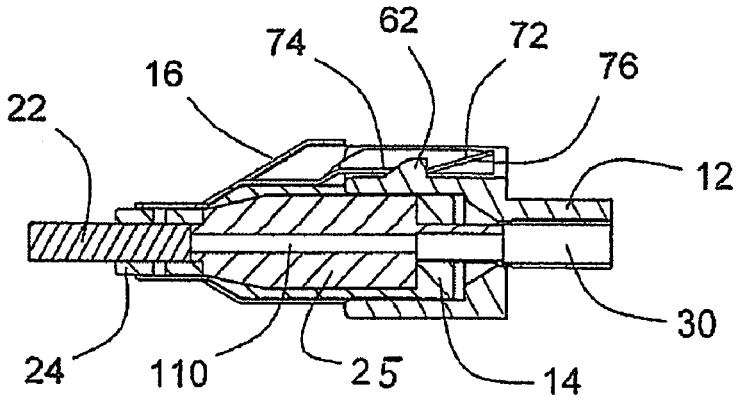
FIG. 3 is a side elevational view taken from Section 3-3 of FIG. 2, illustrating a USB male adapter positioned within the female USB shroud, according to an embodiment.

With reference to FIG. 3, this side elevational sectional view illustrates the male over-mold connector 14 engaged within the receptacle 12. While a USB Mini-B receptacle configuration is illustrated, it will be appreciated that other interface adapter configurations are contemplated by the present invention. The interlocking tab 72 is shown engaging the ramp 62 thus securely engaging the components to one another. If a consumer wants to disengage and release the male over-mold connector portion 14 from the receptacle 12, the raised portion 76 can be lifted up thus allowing the opening 74 to disengage from the ramp 62. The components are now freed, and can then be disassembled.

With reference to FIG. 4, an alternative embodiment assembly 90 is illustrated having many of the same components as that illustrated in FIG. 1. However, the alternative assembly 90 has an integral locking clip 92 that is integrally molded with the over-mold 14. Thus, the separate lock shell 16 illustrated in FIG. 1, is not used in this alternative embodiment device. Instead, the locking clip 92 is used in lieu thereof. The locking clip 92 has a connector portion 94 with a pair of downwardly extending arms that engage a corresponding conically shaped portion 98 of the shell 26. The locking clip 92 further has an interlocking tab portion 100 with its own ramp 102 and opening 104. The locking clip 92 can be made of variety of materials, including metal and plastic. For aiding and grounding of the assembly, the locking clip could preferably be made of metal which in turn engages a metal shroud 106 that is positioned around the perimeter of the shell 26, for enhancing grounding and filtering effects. The metal shroud 106 acts as a filter and protects the shell 26 from external noise so as to enhance clear signal input to the receptacle 12.

The shell 26 of the connector 25 is made of plastic and is provided with a Mini-B device interface 28, and the locking clip 92 is positioned downwardly and secured thereto when the arms 96 engage the contour 98. The part is then ready for an over-mold for the body 20 material to be injected or applied through some other means, and introduced around the shell 26 and locking clip 92. This results in the universal over-mold assembly 90 illustrated in FIG. 4. This provides for a locking clip portion 108 to extend outside of the body 20 of the over-mold resulting in a robust unitary component. The locking clip 92 is rigidly secured and a part of the over-mold body 20 now having its associated consumer interface 28 and cable 22 extending there from. The assembly is now ready for insertion within a receptacle 12.

Figure 6:
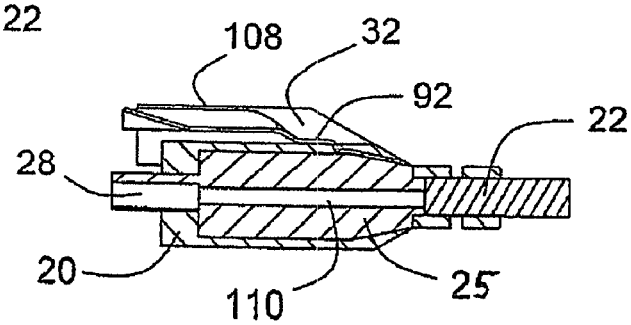
FIG. 6 is a section cut taken from line 6-6 of FIG. 4, illustrating the integral locking clip and the connecter relative to the over-mold, according to an embodiment.

FIG. 6 illustrates a side elevational sectional cut view taken along lines 6-6 of the FIG. 4 alternative embodiment. Here the locking clip 92 is shown integrally molded or otherwise positioned within the body 20 of the over-mold. The locking clip portion 108 is now unitary thus creating a strong, robust assembly for use in a VAP. A wire 110 is shown extending thru the shell 26 and connects the interface 28 to the cable 22.

It is to be understood that the above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed as is:

1. A consumer device interface assembly comprising:

a female shroud having a housing and a flange for mounting to a pc board, the housing having an indexing feature and a ramp integral with the housing, the housing further having a pair of upright slots opened at its sides on each side of said ramp;

an over-mold configured to be received within said female shroud, the over-mold having a body with a pair of upright arms that are laterally received and fit within the pair of upright slots of the female shroud, the body further having a tab;

a connector located within the over-mold, said connector having a cable and a body; and a metal lock shell that is configured to receive said over-mold, said shell having protrusions that receive the pair of upright arms of the over-mold, an interlocking tab portion mates with the ramp of the female shroud between said pair of upright arms for securing the assembly together.

2. The assembly as claimed in claim 1, wherein the metal lock shell and the over-mold are integral.

3. The assembly as claimed in claim 1, wherein the metal lock shell is made of conductive material.

4. The assembly as claimed in claim 1, wherein the body of the connector has a thin metal encasing made of conductive material.

5. The assembly as claimed in claim 1, wherein the metal lock shell further has an opening that is operable to receive the tab on the body of the over-mold so as to lock the over-mold and shell together.

6. The assembly as claimed in claim 1, wherein the metal lock shell further has a shroud that surrounds the cable.

7. The assembly as claimed in claim 1, wherein the connector is at least one of the following types:

a) USB interface;

b) RCA input;

c) Auxiliary input;

f) Jack or port.

8. The assembly as claimed in claim 1, wherein the indexing feature of the female shroud includes a chamfer on a corner of the housing of the shroud, said chamfer mates with a corresponding chamfer of the body of the over-mold.

9. The assembly as claimed in claim 1, wherein the indexing feature of the female shroud includes a lip on an inside surface of the housing.

10. The assembly as claimed in claim 9, wherein the body of the over-mold includes a square shaped corner that engages the lip so as to align the shroud and the over-mold.

11. The assembly as claimed in claim 1, wherein the metal lock shell has a thin profile in a cross-sectional view.

12. The assembly as claimed in claim 1, wherein the body of said connector is molded within said over-mold.

13. The assembly as claimed in claim 1, wherein the metal lock shell and female shroud form a conductive path to a pc board.

14. The assembly as claimed in claim 1, wherein the connector is of the USB mini configuration.

15. The assembly as claimed in claim 1, wherein the over-mold is universal, said body of the over-mold is operable to house a connector of different types.

* * * * *